United States Patent [19]

Takeda

[11] Patent Number: 4,637,554

[45] Date of Patent: Jan. 20, 1987

[54] ELECTROMAGNETIC FUEL INJECTOR WITH MAGNETIC STOP MEMBER

[75] Inventor: Hideto Takeda, Kariya, Japan

[73] Assignee: Nippondenso Co., Ltd., Kariya, Japan

[21] Appl. No.: 715,946

[22] Filed: Mar. 25, 1985

[30] Foreign Application Priority Data

Mar. 27, 1984 [JP] Japan ..... 59-60134

[51] Int. Cl.[4] ..... F02M 51/06

[52] U.S. Cl. ..... 239/585

[58] Field of Search ..... 251/129.15, 129.17, 251/129.18, 129.2, 129.21; 239/585, 533.3–533.12, 456

[56] References Cited

U.S. PATENT DOCUMENTS

| | | | |
|---|---|---|---|
| 2,826,390 | 3/1958 | Bailey | 251/129.21 |
| 3,796,409 | 3/1974 | Burckhardt et al. . | |
| 3,967,597 | 7/1976 | Schlagmuller et al. | 123/32 JV |
| 4,245,789 | 1/1981 | Gray | 239/585 |
| 4,365,747 | 12/1982 | Knapp et al. | 239/585 X |
| 4,519,547 | 5/1985 | Kolach et al. | 239/585 |

FOREIGN PATENT DOCUMENTS 57-186655 11/1982 Japan .

*Primary Examiner*—Joseph F. Peters, Jr.
*Assistant Examiner*—Kevin Patrick Weldon
*Attorney, Agent, or Firm*—Cushman, Darby & Cushman

[57] ABSTRACT

An engine fuel injector has a spring-biased valve member to be electromagnetically moved out of sealing engagement with a valve seat communicated with a fuel injection orifice. The movement of the valve member away from the valve seat is limited by engagement between a stationary stop member and a flange fixed to the valve member. The stop member and the flange have opposed faces to which magnets having the same polarity are attached to assure that the flange is kept closely spaced magnetically from the stop member during the time when the valve member is out of sealing engagement with the valve seat to cause liquid fuel to exist between the flange and the stop member at that time, whereby the squeeze force of the liquid fuel is reduced to shorten the time required for the valve-closing movement of the valve member.

12 Claims, 9 Drawing Figures

ELECTROMAGNETIC FUEL INJECTOR WITH MAGNETIC STOP MEMBER

FIELD OF THE INVENTION

The present invention relates to an electromagnetically actuated fuel injector for use in a fuel injection system for an internal combustion engine.

DESCRIPTION OF THE PRIOR ART

A fuel injector of the class specified has been known to have a movable core adapted to be electromagnetically driven by a solenoid, a valve seat member defining a valve seat and an injection orifice, a valve member connected to the movable core for movement therewith into and out of sealing engagement with the valve seat, a flange formed on one of the movable core and the valve member, and a stationary stop member adapted to cooperate with the flange to limit the movement of the valve member away from the valve seat. A spring member resiliently biases the movable core and the valve member toward the valve seat. When the solenoid is electrically energized, the movable core and the valve member are electromagnetically driven away from the valve seat agianst the spring force so that liquid fuel is forced out of the injector through the injection orifice into an associated internal combustion engine. When the solenoid is deenergized, the movable core is returned by the spring force so that the valve member is moved into sealing engagement with the valve seat to interrupt the injection of the liquid fuel.

In the electromagnetically actuated fuel injector of the structure and arrangement discussed above, when the valve member is electromagnetically moved away from the valve seat, the flange on one of the valve member and the movable core is brought into abutment contact with the stop member and held in this position while the valve member is kept out of engagement with the valve seat, i.e., when the valve is kept open. When the valve is going to be closed, the flange is moved away from the stop member to provide therebetween a progresively increasing gap to be filled with the liquid fuel in the injector. At this moment, the viscous drag of the liquid fuel produces a squeeze force which resists the movement of the flange away from the stop member. The smaller is the gap, the greater is the squeeze force. Accoridngly, the squeeze force impedes the movement of the valve member to its closed position with a resultant disadvantage that the response of the fuel injector is delayed; namely, the valve-closing timing is delayed to prolong the time period while the valve is kept open.

SUMMARY OF THE INVENTION

It is an object of the present invention to provide an improved fuel injector of the class specified above and in which the squeeze force of the liquid fuel is minimized to facilitate a quick return movement of the valve member to its closed position for thereby improving the response of the fuel injector.

The improvement according to the present invention comprises means for magneitcally biasing the stop member and the flange away from each other to keep the flange closely spaced from the stop member when the valve member is out of sealing engagement with the valve seat, i.e., when the valve is open, whereby viscous drag of the liquid fuel in the injector is minimized with resultant advantageous decrease in the squeeze force of the liquid fuel and decrease in the time period needed for the return movement of the valve member to its closed position.

The above and other objects, features and advantages of the present invention will be made more apparent by the following description with reference to the accompanying drawings.

DESCRIPTION OF THE PREFERRED EMBODIMENTS

Figure 1A:
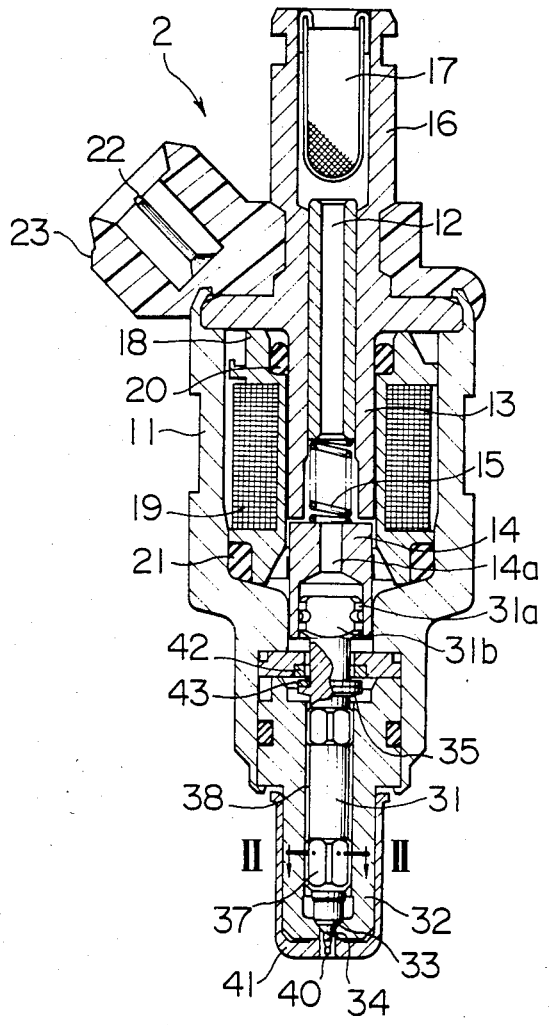
FIG. 1A is an axial sectional view of a needle valve type fuel injector embodying the present invention.
Figure 1B:
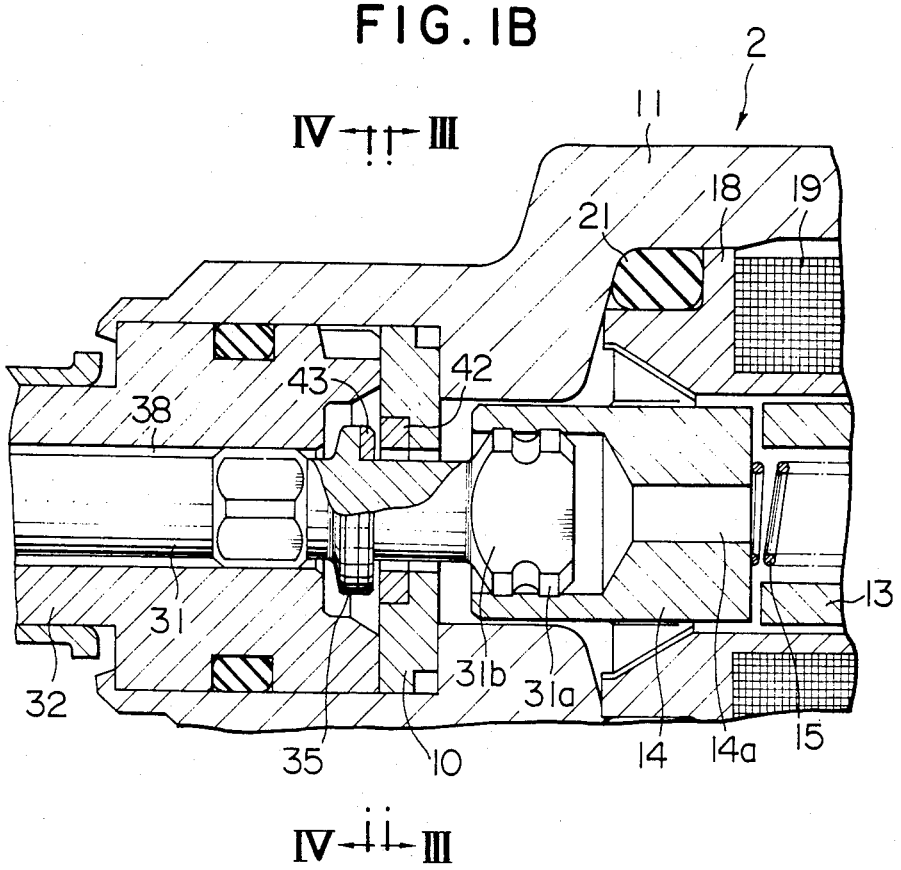
FIG. 1B is an enlarged fragmentary sectional view of the fuel injector shown in FIG. 1A.

Referring to FIGS. 1A and 1B, a needle valve type fuel injector 2 includes a generally cylindrical hollow housing 11 enclosing a fixed iron core 13 disposed substantially concentrically with the housing. The fixed core 13 defines therein a central axial fuel passage 12. A movable iron core 14 is also disposed in the housing in axial alignment with but axially spaced relationship to the fixed core 13. The movable core 14 also defines therein a central axial fuel passage 14*a*. A compression coil spring 15 is disposed between the fixed and movable cores 13 and 14 to resiliently bias the movable core 14 away from the fixed core 13.

In the embodiment shown, the fixed core 13 includes an integral outer connector tube 16 extending outwardly of the housing 11. The connector tube 16 accommodates a filter 17 for removing foreign matters from the liquid fuel to be fed into the fuel injector.

Between the housing 11 and the fixed core 13 is disposed a spool 18 carrying an electromagnetic coil 19 wound thereon. The spool 18 is fixed to the housing 11 and the fixed core 13 with "O"-rings 20 and 21 interposed between the spool and the fixed core and between the spool and the housing, respectively. The electromagnetic coil 19 is electrically connected to terminals one of which is shown at 22. The terminals are secured to and partially embedded in an electric connector 23 formed by a molded plastic material and are adapted to be electrically connected to a conventional electrical control unit, not shown, so that the electromagnetic coil 19 is electrically energized and deenergized in known manner.

The lower end of the movable core 14 is mechanically connected to a needle 31 which constitutes a valve member. The fuel passage 14*a* in the movable core 14 has an enlarged lower section into which an enlarged upper portion 31*a* of the needle 31 is fitted. The enlarged upper portion 31*a* of the needle 31 is formed thereon with circumferential beads or ridges against which the material of the movable core 14 is urged into frictional engagement to secure the needle 31 and the movable core 14 together. The enlarged upper portion 31*a* is axially cut as at 31*b* to provide a fuel passage between the inner peripheral surface of the enlarged lower section of the fuel passage 14*a* and the enlarged upper portion 31*a* of the needle 31 so that the fuel passage 14*a* is communicated with the bottom side of the upper enlarged poriton 31*a* of the needle 31.

An annular stop member 10 is fixed to the inner surface of the housing 11 and extends around the needle 31 below the enlarged upper portion 31*a* in radially outwardly spaced relationship thereto. The needle 31 is provided with an integral annular flange 35 disposed in axially opposed relationship to the stop member 10. The stop member 10 and the flange 35 have axially opposed faces to which annular permanent magnets 42 and 43 are secured, respectively. The permanent magnets 42 and 43 have axially opposed faces of the same polarity so that the stop member 10 and the flange 35 are magnetically biased away from each other in the axial direction of the needle 31. The arrangement is such that, when the coil 19 is electricaly energized, the movable core 14 and thus the needle 31 are axially upwardly driven against the spring 15 and that this upward movement is limited by the stop member 10. More specifically, the needle 31 is upwardly moved until the flange 35 collides with the stop member 10. At this moment, however, the magnetic force of the permanent magnets 42 and 43 cooperates with the force of the compression spring 15 to immediately move the flange 35 a small distance away from the stop member 10 for the purpose to be made apparent later.

Figure 2:
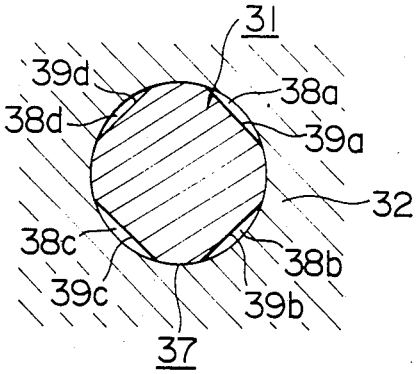
FIG. 2 is an enlarged flagmentary cross-sectional view of the fuel injector taken along line II—II in FIG. 1A.

The part of the needle 31 which extends from the flange 35 substantially to a forward end of the needle is axially slidably received in a fuel passage 38 defined in an axially elongated valve seat member 32 having an upper portion surrounded by housing 11 and a lower portion surrounded by a sleeve or generally cup-shaped member 41 having a bottom formed therein with an opening aligned with an injection orifice 34 formed in the forward end of the valve seat member 32 which also provides an annular valve seat 33 communicated with the injection orifice 34 therein. When the coil 19 is not electrically energized, the spring 15 cooperates with the magnets 42 and 43 to urge the needle 31 downwardly to hold the bottom end of the needle 31 in sealing engagement with the valve seat 33, as shown in FIG. 1A. When the coil 19 is energized, the electromagnetic force generated in the fixed core 13 lifts the movable core 14 and the needle 31 to move the bottom end of the needle 31 away from the valve seat 33 so that the liquid fuel in the fuel passage in the injector is forced under pressure through the injection orifice 34 and through the opening in the bottom of the sleeve 41 into an associated internal combustion engine. The needle 31 has two axially spaced guide portions one of which is indicated at 37 in FIG. 1A and shown in an enlarged scale in FIG. 2. In the guide portion 37, the needle 31 has such a diameter as to cause the needle to be axially guided along the fuel passage 38 in the valve seat member 32, as best seen in FIG. 2. So as not to block the axial fuel passage 38 midway of its axial length, the guide portion 37 is provided with four circumferentially spaced and axially extending planar faces 39*a*–39*d* cooperating with the inner surface of the fuel passage 38 to define four axially extending fuel passages 38*a*–38*d*.

The needle 31 carries an integral pin or tip 40 of a reduced diameter extending through the injection orifice 34 into the opening in the bottom of the sleeve 41 to facilitate atomization of the liquid fuel injected through the injection orifice 34. The pin 40 is protected by the sleeve 41.

The permanent magnets 42 and 43 are made of a magnetic metal selected from a group consisting of alnico-based magnetic metals, ferite-based magnetic metals, rare earth metals and cobalt-based magnetic metals.

Figure 3:
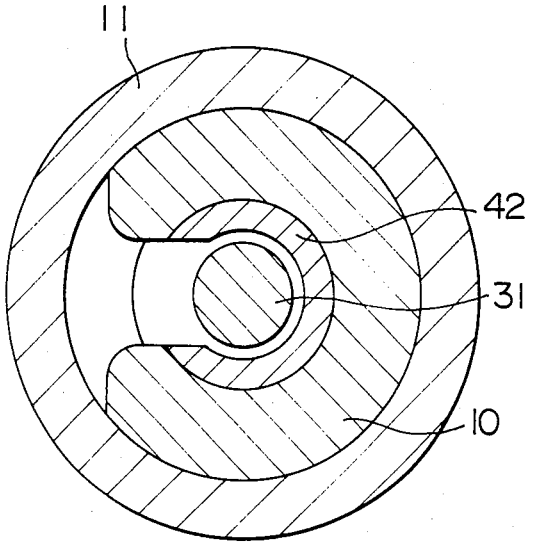
FIG. 3 is an enlarged cross-sectional view of the fuel injector taken along line III—III in FIG. 1B.
Figure 4:
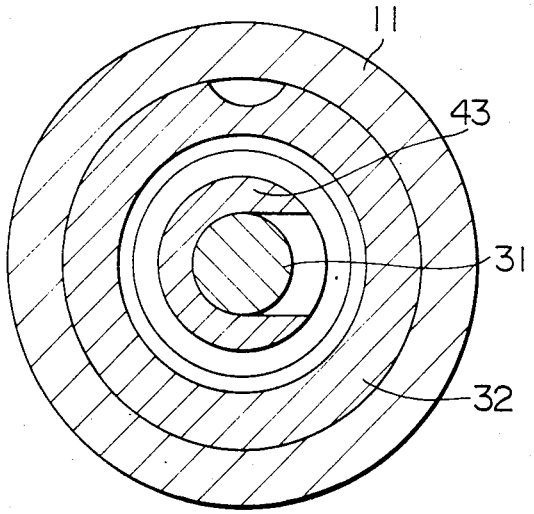
FIG. 4 is an enlarged cross-sectional view of the fuel injector taken along line IV—IV in FIG. 1B.

The magnets 42 and 43 are shown in enlarged scales in FIGS. 3 and 4, respectively. In the case where the stop member 10 and the flange 35 are made of a hard magnetic material such as a high-carbon steel such as a martensitic stainless steel, the magnets 42 and 43 are magnetically attached to the stop member 10 and the flange 35. In order to strengthen the attachment, however, the magnets are preferably attached to the stop member and the flange by means of an adhesive. In additon, the magnets are so sized and shaped as to be in intimate contact with the associated stop member 10 and the flange 35, respectively.

In the case where the stop member 10 and the flange 35 are made of a nonmagnetic hard material such as ceramics, the magnets 42 and 43 are fixed to the stop member and the flange by means of an adhesive.

The magnets 42 and 43 are arranged such that they have axially opposed faces of the same polarity so that the magnetic force biases the magnets away from each other to urge them against the stop member 10 and the flange 35, respectively, as described above. Thus, the magnetic force additionally strengthens the attachment of the magnets to the stop member 10 and the flange 35, respectively.

In operation, when the electromagnetic coil 19 is not energized, the fuel injector is in the position shown in FIG. 1A in which the needle 31 is kept sealingly engaged with the valve seat 33 by the combined forces of the compression spring 15 and the magnets 42 and 43. Thus, the liquid fuel fed under pressure through the connector 16 into the injector is stored in the fuel passage 12 in the fixed core 13 in the passage 14*a* in the movable core 14, in the axial passage 31*b*, between the stop member 10 and the flange 35, around the flange 35 and in the passage 38. When the coil 19 is energized, the fixed core 13 is magnetized to move the movable core 14 against the combined forces of the spring 15 and the magnets 42 and 43. Thus, the needle 31 is also moved upwardly away from the valve seat 33 to communicate the fuel passage 38 with the injection orifice 34, so that the liquid fuel under pressure is injected out of the injector through the injection orifice 34. The injection lasts until the coil 19 is again deenergized. The time period while the coil 19 is energized is determined by a conventional electric control system, not shown.

At the moment when the needle 31 is lifted, the flange 35 on the needle 31 once collides with the stop member 10 but is immediately magnetically spaced therefrom by the magnets 42 and 43 a small distance which is determined by the electric current fed to the coil 19, the magnetic force of the magnets 42 and 43 which biases the stop member 10 and the flange 35 away from each other and the force of the spring 15. The flange 35 is kept spaced the said small distance while the needle 31 is out of sealing engagement with the valve seat 33 to allow the liquid fuel to be injected through the injection orifice 34. Into this small space between the stop member 10 and the flange 35, therefore, the liquid fuel flows while the liquid fuel is being injected. Accordingly, the generation of the squeeze force of the liquid fuel is suppressed to facilitate quick valve-closing movement of the needle 31 when the coil 19 is deenergized.

Figure 6:
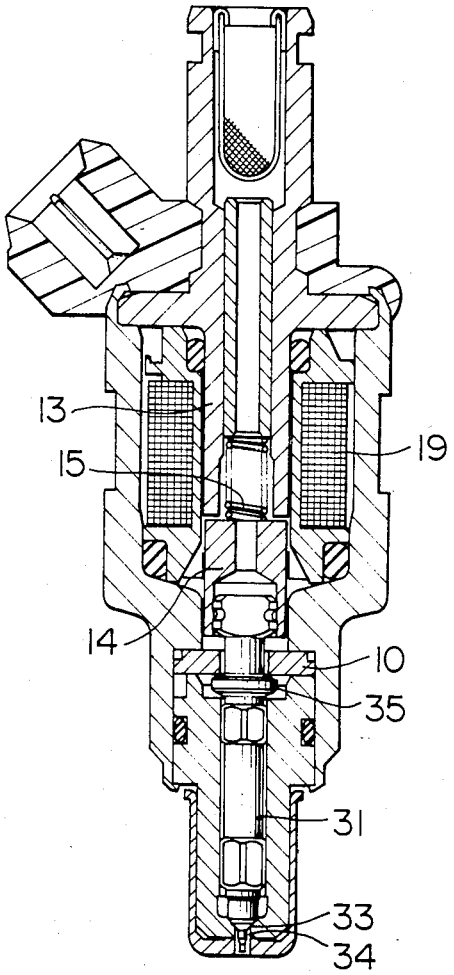
FIG. 6 PRIOR ART
FIG. 6 is an axial sectional view of the prior art needle valve type fuel injector.

The prior art fuel injector shown in FIG. 6 has stop member 10 and flange 35 which, however, are not provided with such magnets as are incorporated in the fuel injector 2 described with reference to FIGS. 1 to 4.

Figure 5:
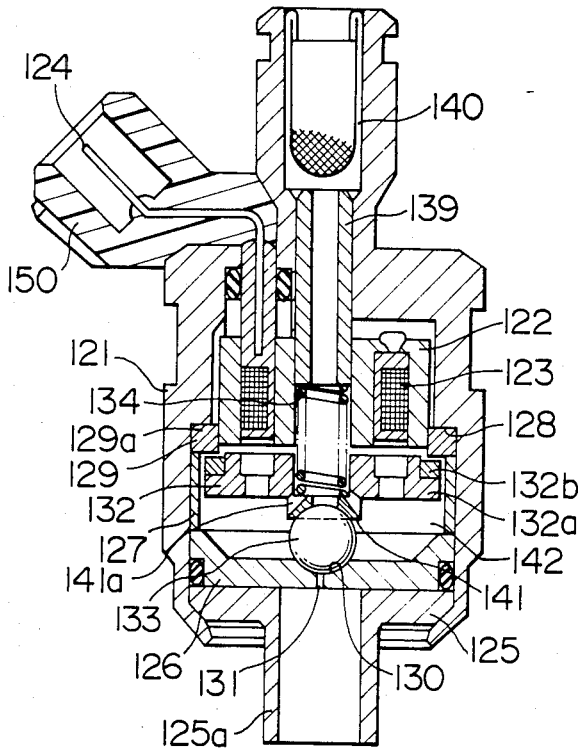
FIG. 5 is an axial sectional view of a ball valve type fuel injector embodying the present invention.

FIG. 5 shows a second embodiment of the fuel injector of the invention which is of a ball valve type. The injector has a generally cylindrical housing 121 which surrounds a cylindrical fixed iron core 122 of a magnetic material. An electromagnetic coil 123 is disposed within the fixed core 122 and is electrically connected to a terminal 124 held in an electric connector 150 of an insulating material such as a plastic material. The connector 150 is adapted to be electrically connected to an electric control unit, not shown, which is operative to electrically energize the coil 123 in a known manner.

The lower end of the housing 121, as viewed in FIG. 5, is open and receives a generally circular end member 125 having a central jet guide tube 125*a*. The end member 125 is fixed to the housing 121 by inwardly bending the lower end portion thereof. A circular valve seat member 126 is disposed in the housing 121 and placed in abutment contact with the inner surface of the end member 125. The valve seat member 125 is provided with an annular and concave valve seat 130 and an axial injection orifice 131 communicated with the valve seat and with the jet guiding tube 125*a* of the end member 125. A cylindrical spacer 127 is disposed in the housing 121 between the fixed core 122 and the valve seat member 126 and has an outer peripheral surface extending in face-to-face engagement with the inner peripheral surface of the housing 121.

More specifically, the inner peripheral surface of the housing 121 is provided with downwardly directed annular shoulder 128 adjacent to the lower end of the fixed core 122. The shoulder 128 is radially outwardly spaced from the fixed core 122. An annular stop 129 formed by a permanent magnet 129*a* is disposed in abutment contact with the shoulder 128 and radially extends between the fixed core 122 and the inner peripheral surface of the housing 121. The spacer 127 extends axially between the stop 129 and the valve seat member 126 and has a cylindrical inner peripheral surface which is radially outwardly offset from the inner peripheral surface of the stop 129.

A circular and generally planar movable core 132 of a magnetic material is disposed axially movably in a cylindrical space 142 defined by the cooperation of the valve seat member 126, the spacer 127, the fixed core 122 and the stop 129. A ball 133 is secured to the bottom or lower face of the movable core 132 by means of a ball holder 141 fixed to the movable core and the ball by welding or soldering. The ball 133 is axially aligned with the valve seat 133. The holder 141 is formed therein with radially and downwardly extending communication apertures 141*a* which communicate the space or fuel chamber 142 downward of the movable core 132 with a central fuel passage therein. The convex outer surface of the ball 133 and the concave surface of the valve seat 130 are complementary such that the ball 133 can be in sealing engagement with the valve seat 130.

A compression coil spring 134 is disposed between the fixed core 122 and the movable core 132 to resiliently bias the movable core downwardly to bring the ball 133 into sealing engagement with the valve seat 130 so that the injection orifice 131 is closed.

The movable core 132 is provided with an integral annular flange 132*a* extending radially outwardly therefrom and disposed in axially aligned relationship to the stop 129. An annular permanent magnet 132*b* is fixed to the annular face of the flange 132*a* directed to the stop 129. The permanent magnets 129*a* and 132*b* have the axially opposed faces of the same polarity so that the magnets are operative to magnetically bias themselves away from each other. The stop 129 is operative to limit the upward movement of the flange 132*a* and thus of the movable core 132.

A pipe 139 is disposed coaxially with the fixed core 122 to define a fuel passage into which liquid fuel under pressure is fed through a filter 140. The inner or lower end portion of the pipe 139 extends into a central axial hole defined in the fixed core 122 and acts to retain the upper end of the spring 134. The fuel fed through the pipe 139 flows downwardly into the fuel chamber 142 through the communication apertures 141*a* formed in the ball holder 141.

The movable core 132 and the permanent magnet 132*b* are so shaped and sized as to be intimately fitted each other to secure them together. If necessary, an adhesive may be used to strongly fix the two members together. The magnetic force generated between the magnets 129*a* and 132*b* is operative to further strengthen the force which holds or secures the movable core 132 and the magnet 132*b* together.

In operation, when the electromganetic coil 123 is not electrically energized, the ball 133 is kept in sealing engagement with the valve seat 130, as in the preceding embodiment, by the combined force of the spring 134 and the magnetic force of the permanent magnets 129*a* and 132*b*. Thus, the injection orifice 131 is closed to prevent the liquid fuel in the fuel injector from being injected therefrom through the injection orifice into the jet guiding tube 125*a*.

When the coil 123 is energized, the fixed core 122 is magnetized to magnetically lift the movable core 132 against the force of the spring 134 and the magnetic force of the magnets 129*a* and 132*b* so that the ball 133 is moved away from the valve seat 130 to allow the liquid fuel in the injector to be injected through the injection orifice 131 and jet guiding tube 125*a* into an associated internal combustion engine, not shown.

The magnetic force of the magnets 129*a* and 132*b*, the electric current to be fed to the electromagnetic coil 123 and the spring force of the compression spring 134 are selected such that, at the moment when the movable core 132 is lifted, the magnet 132*b* on the flange 132*a* once collides with the stop 129 but is immediately separated therefrom a small distance by the magnetic force produced between the magnets 129*a* and 132*b*, as in the preceding embodiment, to suppress the generation of a squeeze force which impedes a succeeding valve-closing downward movement of the movable core 132 which takes place when the coil 123 is deenergized again.

Figure 7:
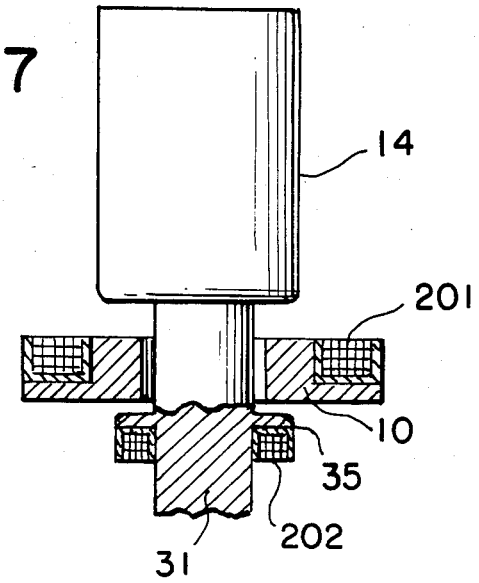
FIG. 7 sows a modification to the first embodiment.

The means for magnetically biasing the stop member and the flange away from each other, which are formed in the described embodiments of the invention by a pair of permanent magnets 42 and 43 or 129*a* and 132*b*, may alternatively be replaced by electromagnetic coils adapted to be energized to magnetize the stop member and the flange when the valve member is out of sealing engagement with the valve seat and at the moment when the valve member is going to be moved toward the valve seat. FIG. 7 shows an example of such alternative modification. The modification is applied to the first embodiment and comprises electromagnetic coils 201 and 202 attached to the stop member 10 and the flange 35, respectively. The system is arranged such that the opposing faces of the stop member and the flange when magnetized have the same polarity to produce an electromagnetic force which biases the flange and stop member away from each other to suppress the generation of the squeeze force.

Figure 8:
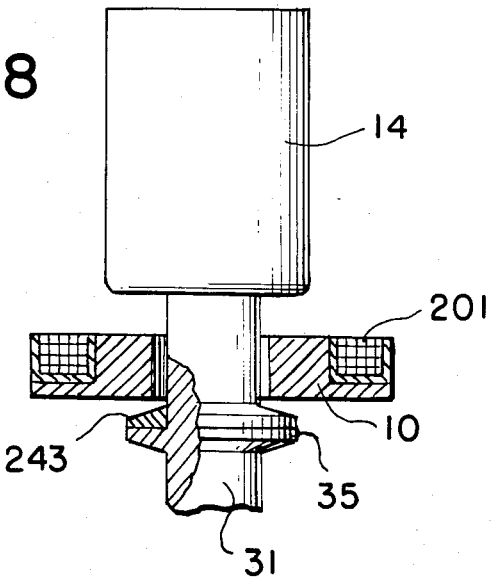
FIG. 8 shows a further modification to the first embodiment.

Further alternatively, one 202 of the two sets of the electromagnetic coils referred to in the preceding paragraph may be replaced by a member 243 formed of a diamagnetic material such as bismuth, as shown in FIG. 8. Such a diamagnetic member may also be substituted for one of the permanent magnets incorporated in each of the described and illustrated embodiments of the invention.

Still further alternatively, the magnetically biasing means may be formed by a permanent magnet attached to one of the flange and the stop member and a set of an electromagnetic member secured to the other and an associated electromagnetic coil.

What is claimed is:

1. In an electromagnetically actuated fuel injector of the type that includes a movable core adapted to be electromagnetically driven by a solenoid, a valve seat member defining a valve seat and an injection orifice, a valve member connected to said movable core for movement therewith into and out of sealing engagement with said valve seat, one of said movable core and said valve member having a flange formed thereon, and a stationary stop member adapted to cooperate with said flange to limit the movement of said valve member away from said valve seat, the improvement which comprises:

means for magnetically biasing said stop member and said flange away from each other to keep said flange closely spaced from said stop member when said valve member is out of sealing engagement with said valve seat.

2. The fuel injector according to claim 1, wherein said magnetically biasing means comprises permanent magnets attached to the opposed faces of said stop member and said flange, respectively, and providing mutually opposed magnetic faces of the same polarity.

3. The fuel injector according to claim 1, wherein said magnetically biasing means comprise electromagnetic coil means attached to said stop member and said flange, respectively and arranged to magnetize said stop member and said flange such that the opposed faces thereof have the same polarity.

4. The fuel injector according to claim 1, wherein said magnetically biasing means comprise a permanent magnet attached to one of the opposed surfaces of said flange and said stop member and a diamagnetic member attached to the other.

5. The fuel injector according to claim 1, wherein said magnetically biasing means comprises an electromagnetic coil means attached to one of of said flange and said stop member, and a diamagnetic member attached to the other.

6. The fuel injector according to claim 4, wherein said diamagnetic member is formed of bismuth.

7. The fuel injector according to claim 5, wherein said diamagnetic member is formed of bismuth.

8. The fuel injector according to claim 3, wherein said electromagnetic coil means are adapted to be electrically energized during the time when said valve member is out of engagement with said valve seat and at the moment when said valve member is going to be moved toward said valve seat.

9. The fuel injector according to claim 1, wherein said magnetically biasing means comprises a permanent magnet attached to one of the opposed faces of said flange and said stop member, and electromagnetic coil means attached to the other of said flange and said stop member, said electromagnetic coil means being arranged to magnetize said the other of said flange and said stop member such that the opposed faces of said permanent magnet and said the other of said flange and said stop member have the same polarity.

10. The fuel injector according to claim 1, wherein said valve member comprises a needle.

11. The fuel injector according to claim 1, wherein said valve member comprises a ball.

12. A fuel injector comprising:

a valve seat member providing an injection orifice and a valve seat;

a valve member movable into sealing engagement with and away from said valve seat to close and open said injection orifice;

means for actuating said valve member to cause the same to close and open said injection orifice;

a flange formed on said valve member;

a stationary stop member adapted to cooperate with said flange to limit the movement of said valve member away from said valve seat; and means for magnetically biasing said stop member and said flange away from each other to keep said flange closely spaced from said stop member when said valve member is out of sealing engagement with said valve seat.

* * * * *